US011650033B2

(12) United States Patent
Batchelder et al.

(10) Patent No.: US 11,650,033 B2
(45) Date of Patent: May 16, 2023

(54) CONTROL PLATE-BASED CONTROL ACTUATION SYSTEM

(71) Applicant: BAE SYSTEMS Information and Electronic Systems Integration Inc., Nashua, NH (US)

(72) Inventors: Jason H. Batchelder, Nashua, NH (US); Matthew F. Chrobak, Groton, MA (US); Ryan Dippel, Arlington, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 244 days.

(21) Appl. No.: 17/111,587

(22) Filed: Dec. 4, 2020

(65) Prior Publication Data

US 2022/0178665 A1 Jun. 9, 2022

(51) Int. Cl.
*F42B 10/64* (2006.01)

(52) U.S. Cl.
CPC ..... *F42B 10/64* (2013.01)

(58) Field of Classification Search
CPC ..... F42B 10/64; F42B 15/01; F42B 10/54; F42B 10/26; B64C 45/02; B64C 13/26
See application file for complete search history.

(56) References Cited

U.S. PATENT DOCUMENTS 2,978,038 A 4/1961 Doman et al.
3,608,509 A * 9/1971 Brooks ..... F42B 19/01 114/23
4,327,886 A * 5/1982 Bell ..... F42B 10/64 60/245
4,431,150 A * 2/1984 Epperson, Jr. ..... F41G 7/222 244/3.21
4,858,480 A 8/1989 Rohde et al.
5,439,188 A * 8/1995 Depew, Jr. ..... F42B 10/64 244/3.21
5,505,408 A * 4/1996 Speicher ..... F42B 10/663 244/3.22
5,950,963 A * 9/1999 Speicher ..... F42B 10/64 244/3.21
6,073,880 A 6/2000 Voigt et al.
(Continued)

FOREIGN PATENT DOCUMENTS

WO 2001092811 12/2001

OTHER PUBLICATIONS

International Search Report, PCT/US21/61332, dated Jun. 29, 2022, 15 pages.

*Primary Examiner* — Medhat Badawi
(74) *Attorney, Agent, or Firm* — Gary McFaline; KPIP Law, PLLC

(57) ABSTRACT

The system and method of a steering a moving object using a control plate-based control actuation system on the moving object. The control plate-based control actuation system having a control plate with at least four fin linkages for connecting at least four fins to the control plate; and three actuators configured to move the control plate to produce movement in two or more of the at least four fins. The system produces roll, pitch, and yaw moments for the moving object using three actuators acting on the control plate and thus moving two or more of the at least four fins all with no loss of performance as compared to systems with four actuators.

16 Claims, 6 Drawing Sheets

(56) References Cited

U.S. PATENT DOCUMENTS 6,149,386 A 11/2000 Rampal
6,247,666 B1 * 6/2001 Baker ..... B63H 11/117 244/3.29
6,360,987 B1 * 3/2002 Sallaee ..... F42B 15/01 244/3.21
6,723,972 B2 * 4/2004 Schroeder ..... F02K 1/008 244/3.24
7,108,223 B2 * 9/2006 Chasman ..... F42B 10/663 244/3.21
7,216,476 B2 * 5/2007 Fink ..... F02K 1/004 239/265.35
7,246,539 B2 * 7/2007 Turner ..... F42B 10/64 244/225
7,255,304 B2 * 8/2007 Ericson ..... F42B 10/64 244/3.28
7,287,725 B2 * 10/2007 Chasman ..... F02K 9/805 60/764
7,354,017 B2 * 4/2008 Morris ..... F42B 10/54 102/501
7,475,846 B2 * 1/2009 Schroeder ..... F42B 10/14 244/3.26
7,923,671 B1 * 4/2011 Huguenin ..... F42B 10/64 244/3.24
8,117,847 B2 * 2/2012 Haight ..... F02K 9/30 60/770
8,240,125 B2 * 8/2012 Kawai ..... F02K 1/002 239/265.17
8,426,788 B2 4/2013 Geswender
8,933,383 B2 1/2015 Celmins
8,993,948 B2 * 3/2015 Geswender ..... F42B 15/01 102/501
9,062,945 B2 * 6/2015 Bruns ..... F42B 10/14
9,086,258 B1 * 7/2015 Vasudevan ..... F42B 30/10
9,163,915 B2 * 10/2015 Roy ..... F42B 10/64
10,288,398 B1 * 5/2019 Verini ..... F42B 5/145
10,578,398 B1 * 3/2020 Bradbury ..... F42B 10/661
10,914,559 B1 * 2/2021 Patel ..... F42B 10/668
11,342,687 B1 * 5/2022 Rossman ..... H01Q 21/067
2006/0065775 A1 * 3/2006 Smith ..... F42B 10/26 244/3.23
2008/0029641 A1 * 2/2008 Carlson ..... F42B 10/64 244/3.24
2013/0334358 A1 * 12/2013 Celmins ..... F42B 10/64 244/3.24
2014/0365035 A1 * 12/2014 Hindman ..... F42B 15/01 701/3
2018/0112958 A1 * 4/2018 Willenbring ..... F42B 10/14
2019/0041178 A1 * 2/2019 Choiniere ..... F42B 15/08
2019/0097547 A1 * 3/2019 Karasikov ..... H02N 2/103
2019/0316887 A1 * 10/2019 Buttolph ..... F42B 10/14
2020/0148329 A1 * 5/2020 White ..... B64C 15/02
2020/0200517 A1 * 6/2020 Wurzel ..... F42C 19/02
2020/0292289 A1 * 9/2020 Wurzel ..... F42B 30/08
2020/0300590 A1 * 9/2020 Choiniere ..... F42B 10/20
2020/0340787 A1 * 10/2020 Zemany ..... F42B 10/02
2020/0363162 A1 * 11/2020 Zemany ..... F41G 7/2213
2020/0400412 A1 * 12/2020 Zemany ..... F41G 7/2253
2021/0116216 A1 * 4/2021 Schorr ..... G05D 1/12
2021/0231406 A1 * 7/2021 Zemany ..... F42B 10/64
2021/0239430 A1 * 8/2021 Zemany ..... F42B 10/64
2022/0178659 A1 * 6/2022 Smith ..... G01S 13/883
2022/0178665 A1 * 6/2022 Batchelder ..... F42B 10/64
2022/0344970 A1 * 10/2022 Affleck ..... H02N 2/188

* cited by examiner

CONTROL PLATE-BASED CONTROL ACTUATION SYSTEM

FIELD OF THE DISCLOSURE

The present disclosure relates to control actuation systems and more particularly to a control plate-based control actuation system with a reduction in actuators at no loss of performance.

BACKGROUND OF THE DISCLOSURE

A typical Control Actuation System (CAS) in a missile or other projectile drives control surfaces with separate actuators. The number of separate actuators depends upon the number of control surfaces or fins that are deployed and, in some cases, includes four control surface and four corresponding actuators. These actuators tend to be expensive, including the actuator itself as well as the motor controllers, feedback sensors, and the like. To drive down the cost of the CAS it is desirable to reduce actuator count and associated electronics.

There are various existing solutions, all of which come at a loss of performance. The most common solution is to eliminate yaw control and fly in a bank-to-turn configuration where only two actuators are used. There, one actuator controls two fins to generate roll moments and the other actuator controls two fins to generate pitch. This methodology results in a reduced response rate of the maneuverability for the system and effects the ability to engage with fast maneuvering targets.

Another common approach to reducing actuator count is to tie two opposing fins together so that they can only contribute to pitch control using a single actuator. The remaining two fins each have an actuator and are responsible for roll and yaw control, respectively. This results in not being able to get full roll and yaw capabilities of independently controlling the typical four control surfaces. This methodology also reduces the system's ability to engage fast maneuvering targets.

A less common approach to reducing actuator count is to use a transmission that takes three rotational inputs from motors and using a series of gears distributes that to the four control surfaces. This is not a common solution because of the complexity, the backlash, the losses, and the increased weight of a transmission often outweighs any benefits of eliminating one actuator.

Certain solutions use rotating systems such as helicopter rotors. These systems have to be complex, heavy duty, and robust to transfer the pitch and cyclic to highly loaded and fast spinning rotor blades. Some cases have complex gear box mechanisms to generate the pitch and cyclic effects or hydraulic systems focused on a hemispherical bearing system.

Other solutions focus on bank to turn systems. In some cases, they use high frequency voice coils so that the electronics can spin with the shell while only the lifting surfaces are "derolled." While it may be an interesting approach, it is a different problem from that solved by the present disclosure as it only results in bank to turn capability (pitch & roll), while the present approach results in skid turning capability (pitch, yaw, and roll. independently).

Wherefore it is an object of the present disclosure to overcome the above-mentioned shortcomings and drawbacks associated with the conventional control actuation systems.

SUMMARY OF THE DISCLOSURE

One aspect of the present disclosure is A control plate-based control actuation system for steering a moving object, comprising: a control plate having at least four fin linkages for connecting at least four fins to the control plate; and three actuators configured to move the control plate to produce movement in two or more of the at least four fins; wherein the three actuators work to either push/pull or tilt the control plate control deflections of the two or more of the at least four fins.

One embodiment of the control plate-based control actuation system is wherein the three actuators are linear actuators. In certain embodiments, the three actuators work together to either push/pull or tilt the control plate according to a three-dimensional planar equation $a(x-P_x)+b(y-P_y)+c(z-P_z)=0$.

Another embodiment of the control plate-based control actuation system is wherein the control actuation system is in a tail section of the moving object. Yet another embodiment of the control plate-based control actuation system is wherein the control actuation system is in a mid-body section of the moving object.

Still yet another embodiment of the control plate-based control actuation system further comprises a guidance system for controlling the control plate-based control actuation system to steer the moving object toward a target. In some cases, combinations of pitch, yaw, and roll inputs are combined in an actuator mapping and generate pitch, yaw, and roll commands.

In certain embodiments, the control plate defines a plane and is connected to the four control surfaces via right angle linkage.

Another aspect of the present disclosure is a control plate-based control actuation system for steering a moving object, comprising: a control plate having at least four fin linkages for connecting at least four fins to the control plate; and three actuators configured to move the control plate to produce movement in two or more of the at least four fins; wherein a first actuator is configured to push or pull the control plate to move all fins simultaneously to create a roll moment in the moving object; wherein a second actuator is configured to push or pull the control plate to move a first pair of fins located opposite one another on the control plate to create a pitch moment in the moving object; and wherein a third actuator is configured to push or pull the control plate to move a second pair of fins located opposite one another on the control plate to create a yaw moment in the moving object.

One embodiment of the control plate-based control actuation system is wherein the control actuation system is in a tail section of the moving object. In some cases, the control actuation system is in a mid-body section of the moving object.

Another embodiment of the control plate-based control actuation system further comprises a guidance system for controlling the control plate-based control actuation system to steer the moving object toward a target. In certain embodiments, the first actuator, second actuator, and third actuator are linear actuators.

Yet another aspect of the present disclosure is a method of steering a moving object, comprising: providing a control plate-based control actuation system on the moving object, the control plate-based control actuation system comprising: a control plate having at least four fin linkages for connecting at least four fins to the control plate; and three actuators configured to move the control plate to produce movement in two or more of the at least four fins; wherein the three actuators work together to either push/pull or tilt the control plate to control deflections of the two or more of the at least four fins.

One embodiment of the method further comprises: pushing or pulling the control plate, via a first actuator, to move all fins simultaneously to create a roll moment in the moving object; pushing or pulling the control plate, via a second actuator, to move a first pair of fins located opposite one another on the control plate to create a pitch moment in the moving object; and pushing or pulling the control plate, via a third actuator, to move a second pair of fins located opposite one another on the control plate to create a yaw moment in the moving object.

Another embodiment of the method further comprises controlling the control plate-based control actuation system, via a guidance system, to steer the moving object toward a target. In some cases, the control actuation system is in a tail section of a round. In other cases, the control actuation system is in a mid-body section of the moving object.

Yet another embodiment of the method further comprises controlling the control plate-based control actuation system, via a guidance system, to steer the moving object toward a target.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

The control plate concept according to the principles of the present disclosure has the benefit of reducing the actuator count, at no loss of pitch, yaw, or roll control. The backlash of the system can be easily controlled through tolerancing of the interfaces between the control plate and the actuator and the control plate and the fin linkages. In some cases, anti-backlash gears or knuckle joints and threaded rods may be used to manage the backlash. And compliant materials (e.g., nylon bushings) can be used at any of the joint locations to eliminate any remaining backlash.

A swash plate is often used in helicopter rotors to combine two control inputs pitch (up/down) and cyclic (forward/back and left/right) inputs and rotate the individual rotor blades a specified amount versus their angular location throughout rotation. Here, three control inputs (Pitch, Yaw, and Roll) are mapped to three linear actuator deflections. In one embodiment, those deflections push/pull (if all actuators move together) and tilt (if they move proportionally) the control plate, which is connected to the control surfaces using linkages.

In one embodiment, pushing/pulling the control plate moves all of the control surfaces together, generating a roll input. Tilting the control plate moves opposing control surfaces and generates pitch and yaw inputs. Combinations of pitch, yaw and roll inputs can be combined in the actuator mapping, and generate output pitch, yaw, and roll commands. Assuming linear control (common in missile systems), combining inputs like this comes at no loss of control performance. Even outside of the linear region, the losses are small and are identical to the four actuator systems, but with all the benefits of a reduced actuator system.

In one embodiment, a missile tail kit is shown, but the present disclosure could apply to any system where three control inputs need to be mapped to four or more outputs.

Figure 1A:
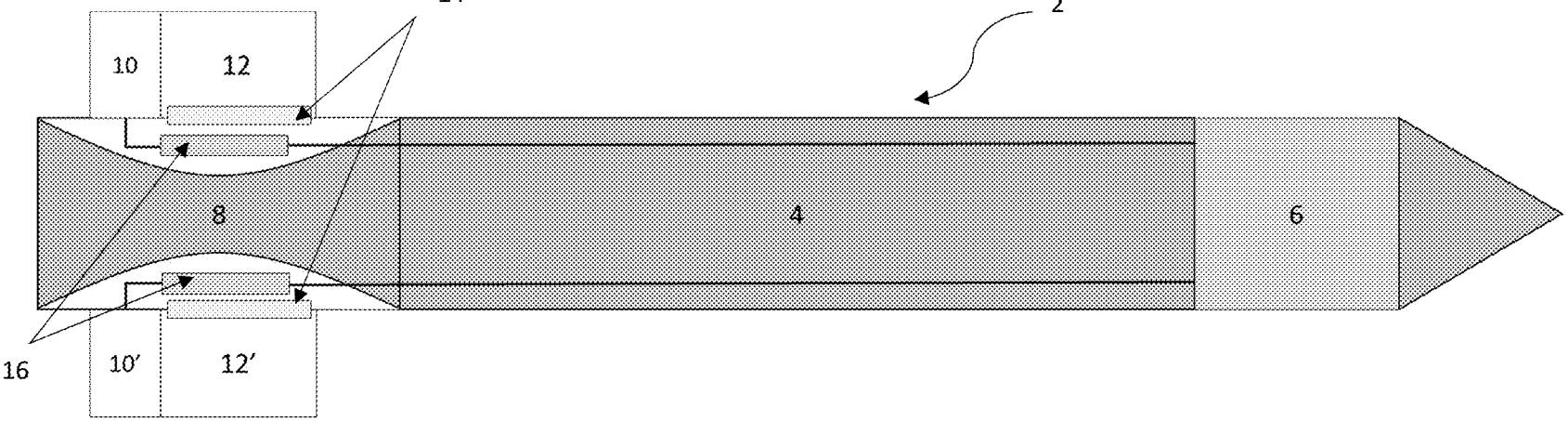
FIG. 1A shows a diagram of one embodiment of a tail kit control plate-based control actuation system according to the principles of the present disclosure.

Referring to FIG. 1A, a diagram of a tail kit control plate-based control actuation system according to the principles of the present disclosure is shown. More specifically, a control actuation system (CAS) in the tail of a round 2 provides physical control authority to maneuver the round. In one embodiment, a round is a moving object, a weapon, a projectile, a ballistic, a bullet, a munition, or a guided weapon. Typically, four motors drive the four flaps on the back of the tail fins. Reducing the number of motors or actuators improves the size, weight, power, and cost (SWAP-C) of the CAS (less motors=less power, less controllers ($), less communication lines, etc.). Here, the round 2 comprises a head section 6, a mid-body section 4, and a tail section 8. In the head section 6 is generally the missile warhead, fuze, and guidance kit, but the guidance kit can be located elsewhere onboard the missile. In the mid-body section 4 there may be a rocket motor. In the tail section 8, a nozzle geometry provides for space around the periphery to accommodate flaps 10, fins 12, motors 16, and deployment springs 14. Here, a fin/flap combo is shown, which can be less sensitive to an angular resolution of the flap than full fin rotation, but full fin rotation is also a possibility. In operation, after launch the deployment spring cooperates with the motors to deploy the fins and the motors then control the flaps/fins to guide the projectile.

Figure 1B:
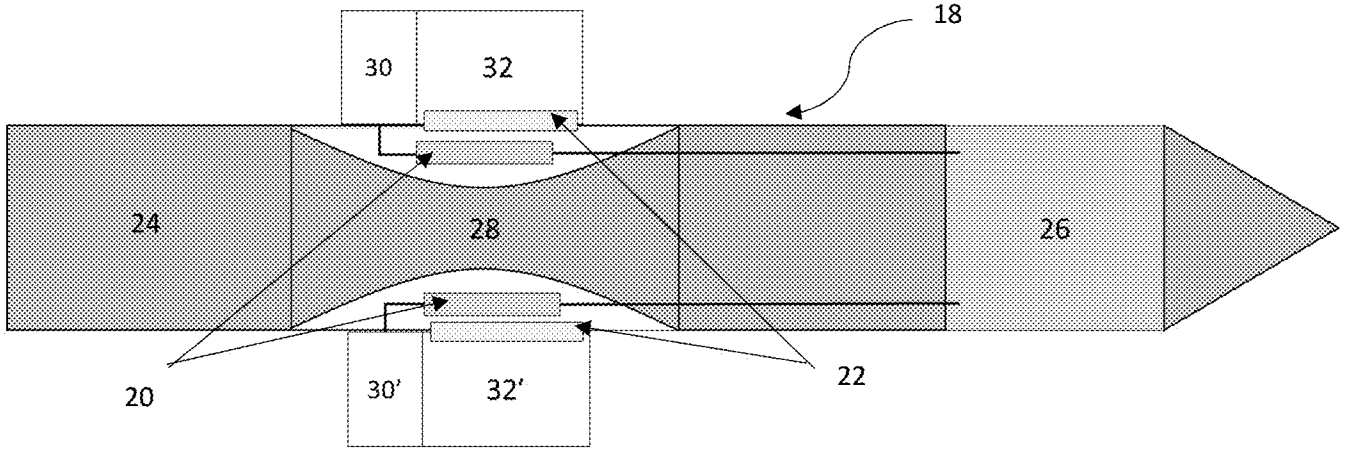
FIG. 1B shows a diagram of one embodiment of a mid-body kit control plate-based control actuation system according to the principles of the present disclosure.

Referring to FIG. 1B, a diagram of a mid-body kit control plate-based control actuation system according to the principles of the present disclosure is shown. More specifically, a control actuation system (CAS) in the mid-body of a round 18 provides physical control authority to maneuver the round. In one embodiment, a round is a moving object, a weapon, a projectile, a ballistic, a bullet, a munition, or a guided weapon. Here, the round 18 comprises a head section 26, a mid-body section 28, and a tail section 24. In the head section 26 is generally the missile warhead, fuze, and guidance kit. In the tail section 44 there may be a rocket motor. In the mid-body section 28, a nozzle geometry provides for space around the periphery to accommodate flaps 30, fins 32, motors 20, and deployment springs 22. Here, a fin/flap combo is shown, which can be less sensitive to an angular resolution of the flap than full fin rotation, but full fin rotation is also a possibility.

As noted previously, common CAS configuration is four motors to control four active surfaces (e.g., fins). Reduction of actuators are typically done by either limiting control axes, transmissions, or tying surfaces together. In some cases, one actuator moves two pitch fins together, and another actuator moves two roll fins together. In all cases these prior systems either limit capability in one or more axes or eliminates a control axis all together.

In one embodiment of the present disclosure, a control plate is used as a low-cost skid steer (independently controlled pitch, yaw, and roll control axes) projectile control system. The system can be built "around" any central geometry (i.e. if this is a nose mounted guidance system it can be built around a seeker, or if this is a tail mounted guidance kit it can be built around a rocket nozzle or other motor like a jet engine) while still using only three actuators. There are other missile control systems that use three actuators, but they use complicated gear boxes and cannot be built around a central geometry. Here, low cost linear actuators are used to create the motion of the control plate that translates to the control surface deflections.

Figure 2:
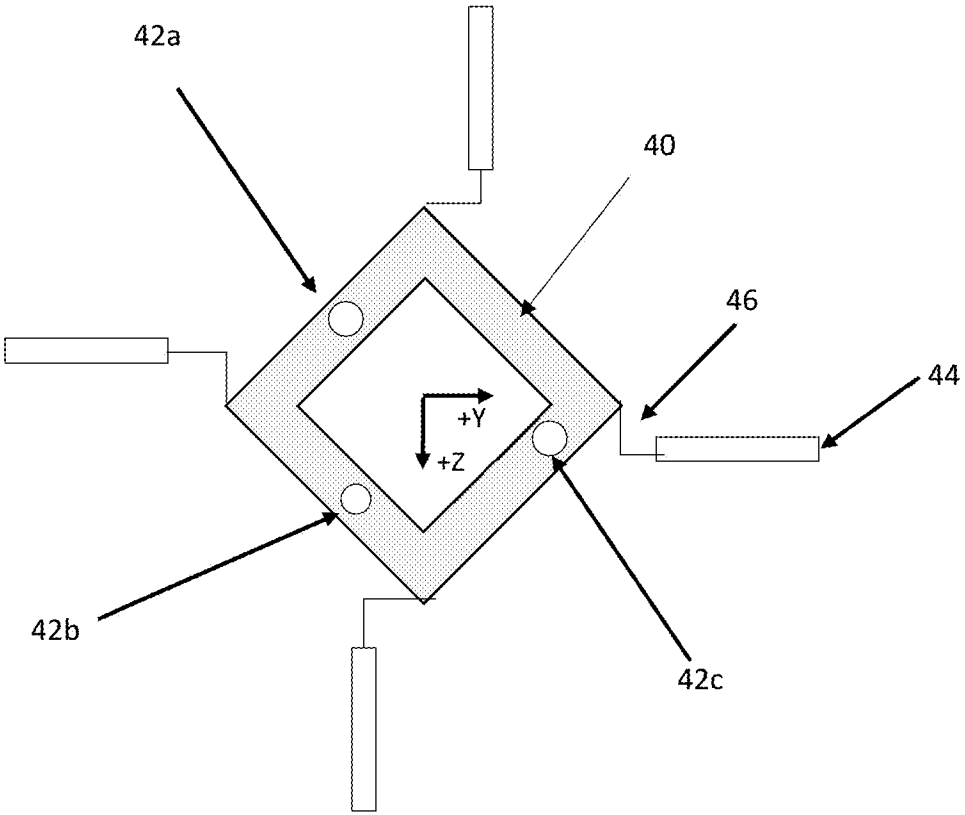
FIG. 2 shows a diagram of one embodiment of a control plate-based control actuation system according to the principles of the present disclosure.

Referring to FIG. 2, a diagram of one embodiment of a control plate-based control actuation system according to the principles of the present disclosure is shown. More specifically, a control plate 40 is shown having four linkages 46 and four fins 44. There are three actuators 42*a*, 42*b*, and 42*c*. In certain embodiment, the control plate can be any shape so long as it defines a plane and is connected to the four control surfaces via right angle linkage. In some cases, additional control surfaces are used. Because the control plate is treated as a rigid planar surface, it only needs three linear actuators pushing on it to define that plane. Here, viewing ALF (Aft Looking Forward) a "+" configuration is shown, but an "x" configuration should be identical. Also shown, are the linkage points on the vertical/horizontal lines and fins are off-center but the actual concept would have the fins aligned vertical/horizontal and the linkage points would be offset.

Figure 3A:
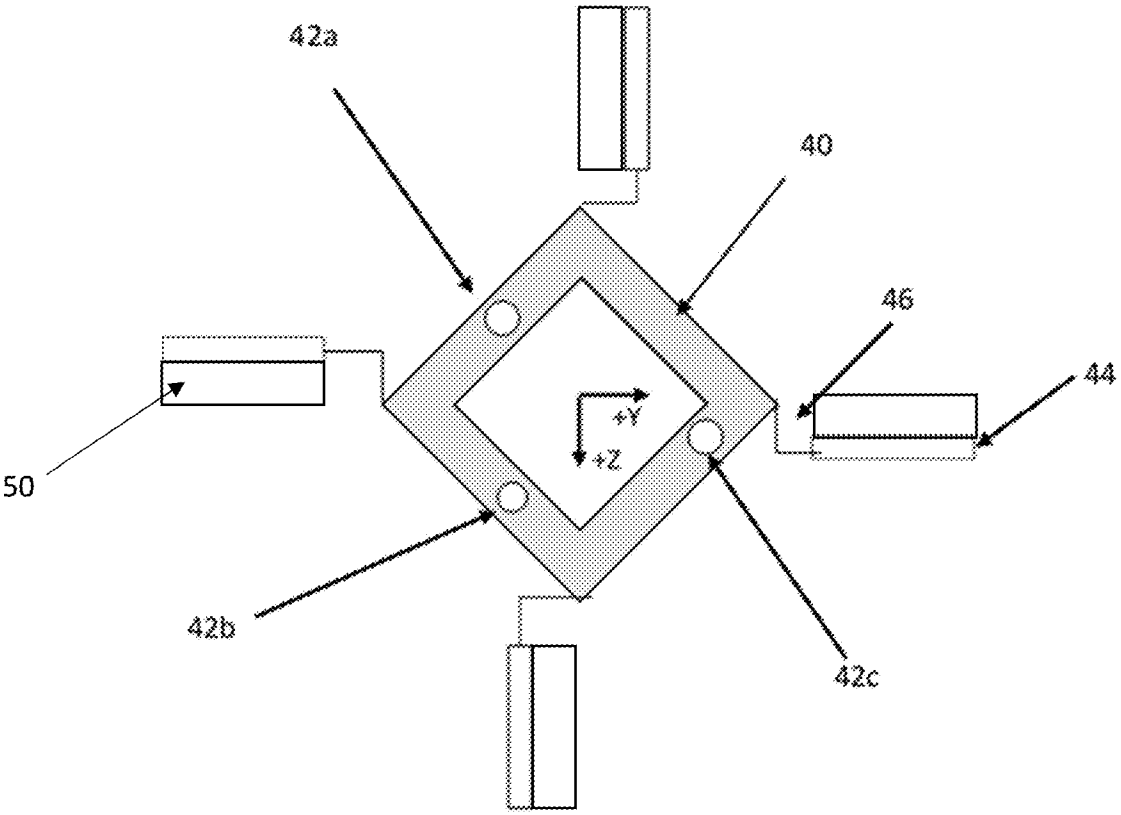
FIG. 3A shows a diagram of one embodiment of the control plate-based control actuation system creating a roll moment according to the principles of the present disclosure.

Referring to FIG. 3A, a diagram of one embodiment of the control plate-based control actuation system creating a roll moment according to the principles of the present disclosure is shown. More specifically, pushing the control plate into the page rotates the linkages for all four fins together 50. In the configuration shown, this would result in a positive fin rotation for all four fins, which would result in a positive roll moment (+X). Pulling the control plate therefore would result in a negative roll moment.

Figure 3B:
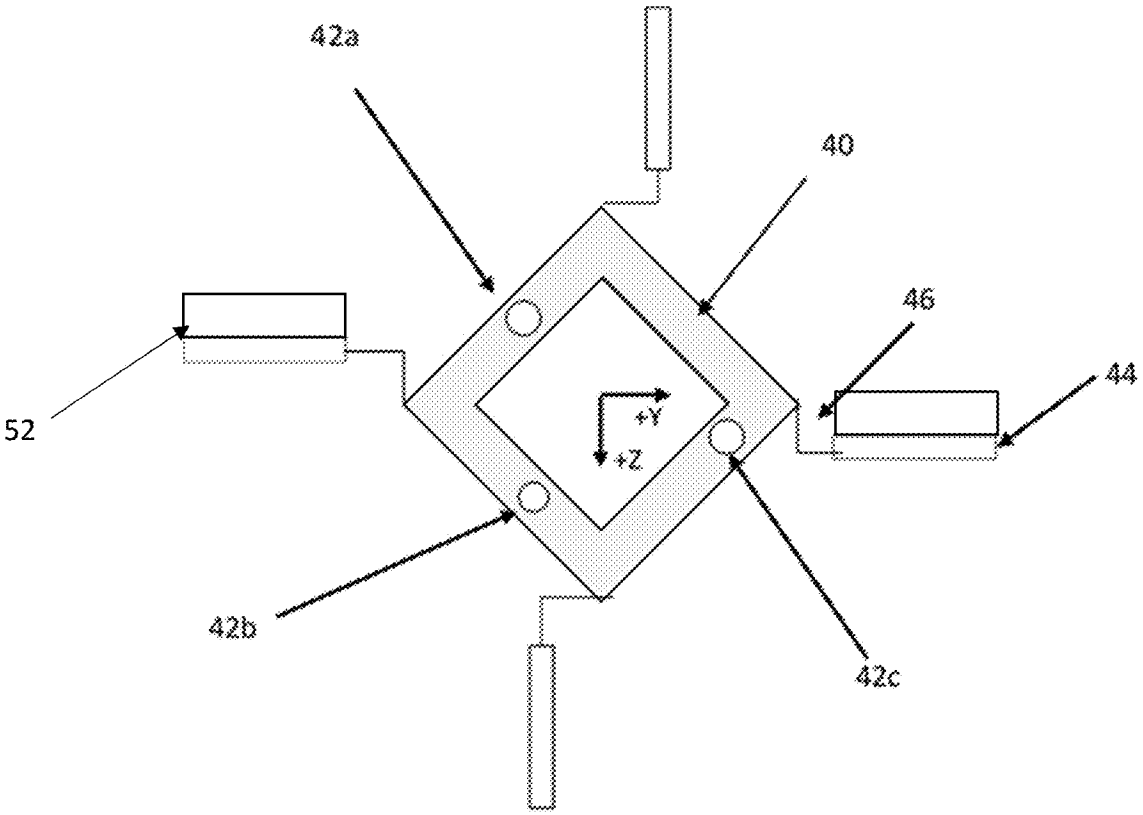
FIG. 3B shows a diagram of one embodiment of the control plate-based control actuation system creating a pitch moment according to the principles of the present disclosure.

Referring to FIG. 3B, a diagram of one embodiment of the control plate-based control actuation system creating a pitch moment according to the principles of the present disclosure is shown. More specifically, rotating the plane about the vertical axis (about −Z) does not affect the top/bottom fins because the linkage can pivot at the linkage/control plate interface. The only way to rotate the fin is to push/pull the end of its linkage. Therefore, using the actuators to tilt the control plate about the vertical axis (−Z) rotates the left/right fin opposite one-another 52, resulting in both fins generating +Z forces and if they are aft of the center of gravity then this would generate a +Pitch moment (nose up). Negative Pitch moments can be generated by reversing the tilt direction. If the fin assembly is forward of the center of gravity, such as for a nose mounted control system, the direction of the pitching moment is reversed for the same tilt direction of the control plane, but this can be accounted for in the guidance kit electronics and/or software. In certain embodiments, a guidance kit would include the electronics and firmware and/or software to control the missile (by defining control deflections that are used to define the actuator deflections).

Figure 3C:
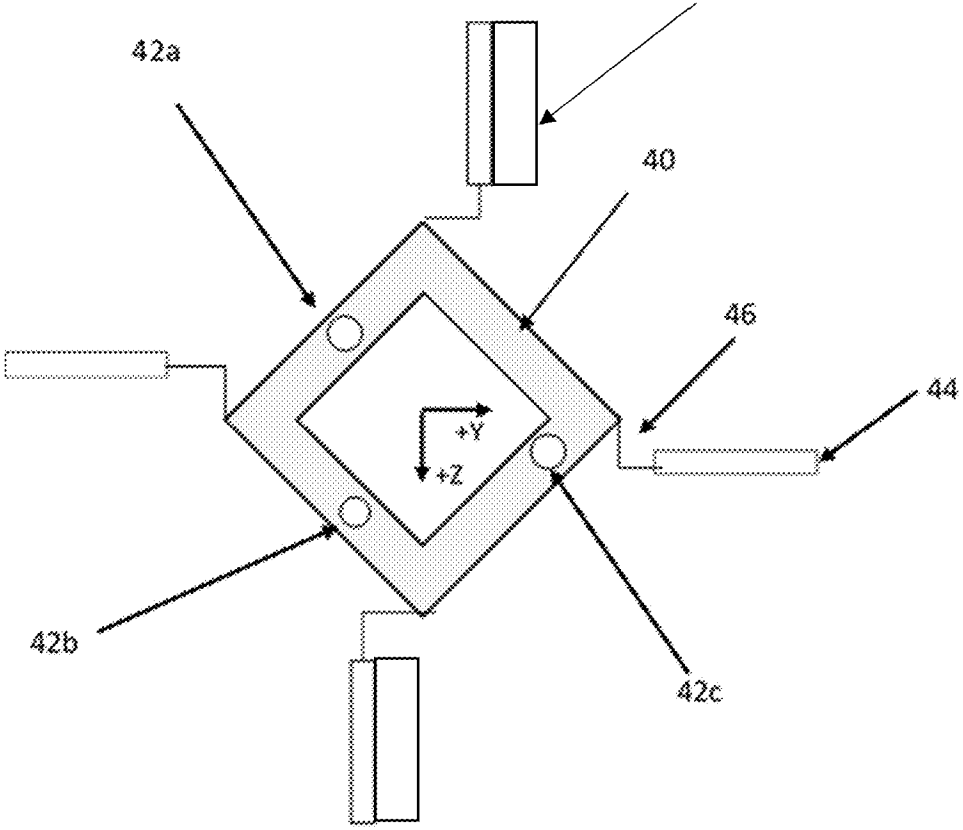
FIG. 3C shows a diagram of one embodiment of the control plate-based control actuation system creating a yaw moment according to the principles of the present disclosure.

Referring to FIG. 3C, a diagram of one embodiment of the control plate-based control actuation system creating a yaw moment according to the principles of the present disclosure is shown. More specifically, rotating the plane about the horizontal axis (about +Y) does not affect the left/right fins because the linkage can pivot at the linkage/control plate interface. The only way to rotate the fin is to push/pull the end of its linkage. This rotates the top/bottom fin opposite one-another 54, resulting in both fins generating −Y forces and if they are aft of the center of gravity this would generate a +Yaw moment (nose right). Identically to the pitch moment, the yaw moment can be reversed by reversing the tilt of the control plate, and the differences if the fins are forward of the CG can be accounted for in the guidance kit.

In one embodiment of the present disclosure, the control plate shape is arbitrary. It is simply a way of defining a plane that the four or more linkages and three actuators are connected to. Each fin's movement is a function only of how much its linkage point has moved. It is not affected by rotation of the control plate about the same axis that the linkage is attached. It is only affected by the push/pull of the total control plate (pitch), and the rotation about the axis 90° out of phase of the linkage points (cyclic). By each fin being sensitive to two movement directions, but not a third, enables combined Pitch, Yaw, and Roll control inputs for three independent control axes. Since the control plate is simply defining a plane, only 3 "points" are required to fully define that plane hence, only three linear actuators.

While the shape of the control plane can be somewhat arbitrary, for the control algorithms it is assumed to be a three-dimensional plane that is capable of being translated or rotated. In certain embodiments, the linkage location is distributed roughly equally to balance stresses/actuator forces. The three-dimensional points where the actuators are linked to the control planes are defined as P, Q, and R, each with unique X, Y, and Z coordinates ($P_x$, $P_y$, and $P_z$ for example). The coordinates of P, Q, and R are known. The Y and Z of the actuator linkage points are defined in the design of the CAS (they represent the horizontal and vertical offsets of the actuators from the missile centerline). The X component can easily be resolved from the actuator feedback. With the knowledge of the P, Q, and R coordinates the normal vector of the control plane is defined as $\vec{n}=\overrightarrow{PQ}\times\overrightarrow{QR}=\langle a,b,c\rangle$. The $\langle a,b,c\rangle$ coefficients can then be used in the three-dimensional planar equation $a(x-P_x)+b(y-P_y)+c(z-P_z)=0$ to calculate the three-dimensional location of any point on this plane, including the fin linkage locations. Similar methodology can be used to transform the fin linkage location to a fin deflection, as well as going from a desired fin deflection back to required actuator commands.

The control plate-based control actuation system has several benefits, including three independent control axes using only three linear actuators. Linear actuators tend to have negligible internal backlash; therefore, the backlash of the system should be controllable via tolerance control of the "slop" in the linkage locations as described above. An arbitrary control plate shape can be built around other components such as a rocket nozzle, electronics, or rotating geometries such as a drive shaft. This concept can be applied to any number of control surfaces assuming they physically fit in the space available.

Figure 4:
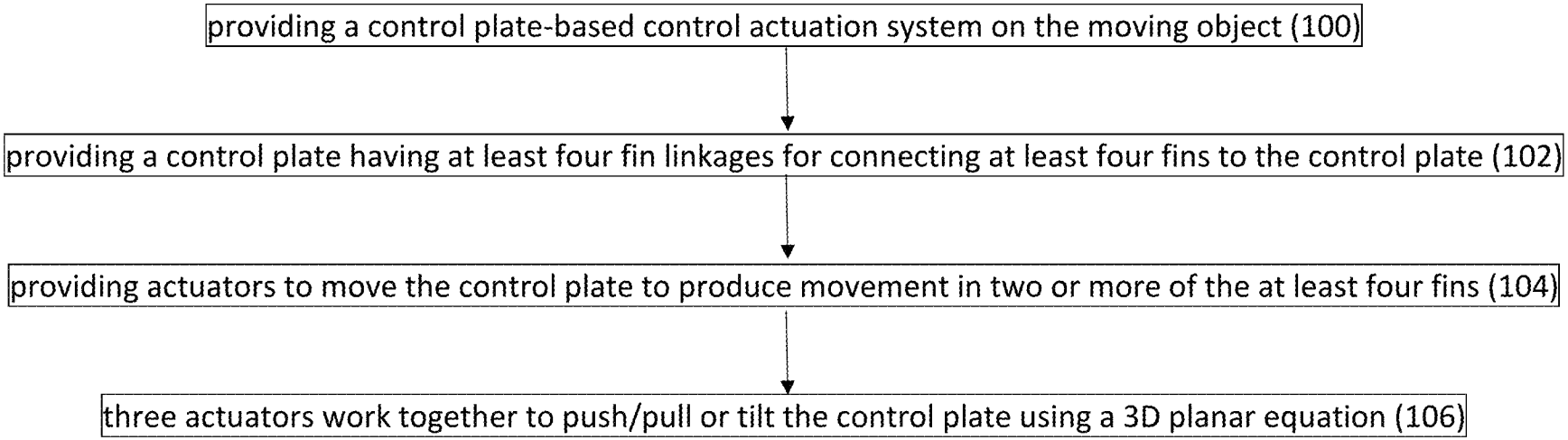
FIG. 4 is a flowchart of one embodiment of a method of using a control plate-based control actuation system according to the principles of the present disclosure.

Referring to FIG. 4, a flowchart of one embodiment of a method of using a control plate-based control actuation system according to the principles of the present disclosure is shown. More specifically, a method of steering a moving object, comprises providing a control plate-based control actuation system on the moving object 100. In some cases, the control plate-based control actuation system comprises a control plate having at least four fin linkages for connecting at least four fins to the control plate 102; and three actuators configured to move the control plate to produce movement in two or more of the at least four fins 104. The control deflections of the two or more of the at least four fins are a result of how the actuators work together to either push/pull or tilt the control plate according to a three-dimensional planar equation 106 $a(x-P_x)+b(y-P_y)+C(z-P_z)=0$.

In certain embodiments, pushing or pulling the control plate using a first actuator moves all fins simultaneously to create a roll moment in the moving object. In some cases, pushing or pulling the control plate using a second actuator moves a first pair of fins located opposite one another on the control plate to create a pitch moment in the moving object; and pushing or pulling the control plate using a third actuator moves a second pair of fins located opposite one another on the control plate to create a yaw moment in the moving object.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A control plate-based control actuation system for steering a moving object, comprising:

a control plate having at least four fin linkages for connecting at least four fins to the control plate; and three actuators configured to move the control plate to produce movement in two or more of the at least four fins;

wherein the three actuators work to either push/pull or tilt the control plate control deflections of the two or more of the at least four fins, and wherein the three actuators work together to either push/pull or tilt the control plate according to a three-dimensional planar equation $a(x-P_x)+b(y-P_y)+c(z-P_z)=0$.

2. The control plate-based control actuation system according to claim 1, wherein the three actuators are linear actuators.

3. The control plate-based control actuation system according to claim 1, wherein the control actuation system is in a tail section of the moving object.

4. The control plate-based control actuation system according to claim 1, wherein the control actuation system is in a mid-body section of the moving object.

5. The control plate-based control actuation system according to claim 1, further comprising a guidance system for controlling the control plate-based control actuation system to steer the moving object toward a target.

6. The control plate-based control actuation system according to claim 1, wherein combinations of pitch, yaw, and roll inputs are combined in an actuator mapping and generate pitch, yaw, and roll commands.

7. The control plate-based control actuation system according to claim 1, wherein the control plate defines a plane and is connected to the four control surfaces via right angle linkage.

8. A control plate-based control actuation system for steering a moving object, comprising:

a control plate having at least four fin linkages for connecting at least four fins to the control plate; and three actuators configured to move the control plate to produce movement in two or more of the at least four fins;

a guidance system for controlling the control plate-based control actuation system to steer the moving object toward a target;

wherein a first actuator is configured to push or pull the control plate to move all fins simultaneously to create a roll moment in the moving object;

wherein a second actuator is configured to push or pull the control plate to move a first pair of fins located opposite one another on the control plate to create a pitch moment in the moving object; and wherein a third actuator is configured to push or pull the control plate to move a second pair of fins located opposite one another on the control plate to create a yaw moment in the moving object.

9. The control plate-based control actuation system according to claim 8, wherein the control actuation system is in a tail section of the moving object.

10. The control plate-based control actuation system according to claim 8, wherein the control actuation system is in a mid-body section of the moving object.

11. The control plate-based control actuation system according to claim 8, wherein the first actuator, second actuator, and third actuator are linear actuators.

12. A method of steering a moving object, comprising:

providing a control plate-based control actuation system on the moving object, the control plate-based control actuation system comprising:

a control plate having at least four fin linkages for connecting at least four fins to the control plate; and three actuators configured to move the control plate to produce movement in two or more of the at least four fins;

pushing or pulling the control plate, via a first actuator, to move all fins simultaneously to create a roll moment in the moving object;

pushing or pulling the control plate, via a second actuator, to move a first pair of fins located opposite one another on the control plate to create a pitch moment in the moving object; and pushing or pulling the control plate, via a third actuator, to move a second pair of fins located opposite one another on the control plate to create a yaw moment in the moving object;

wherein the three actuators work together to either push/pull or tilt the control plate to control deflections of the two or more of the at least four fins.

13. The method according to claim 12, further comprising controlling the control plate-based control actuation system, via a guidance system, to steer the moving object toward a target.

14. The method according to claim 12, wherein the control actuation system is in a tail section of a round.

15. The method according to claim 12, wherein the control actuation system is in a mid-body section of the moving object.

16. The method according to claim 12, further comprising controlling the control plate-based control actuation system, via a guidance system, to steer the moving object toward a target.

* * * * *